US007369794B2

(12) United States Patent
Kawai et al.

(10) Patent No.: US 7,369,794 B2
(45) Date of Patent: May 6, 2008

(54) IMAGE RECORDING APPARATUS AND OPENING AND CLOSING MECHANISM

(75) Inventors: Takamitsu Kawai, Obu (JP); Yoshio Nakagawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 178 days.

(21) Appl. No.: 11/189,989

(22) Filed: Jul. 27, 2005

(65) Prior Publication Data

US 2006/0029424 A1 Feb. 9, 2006

(30) Foreign Application Priority Data

Aug. 4, 2004 (JP) ..... 2004-228261

(51) Int. Cl.
*G03G 15/00* (2006.01)
*G03G 21/16* (2006.01)

(52) U.S. Cl. ..... 399/125; 399/107; 399/114

(58) Field of Classification Search ..... 399/125, 399/107, 109, 114; 347/138, 152; 312/325, 312/327, 328, 350
See application file for complete search history.

(56) References Cited

U.S. PATENT DOCUMENTS 4,754,293 A * 6/1988 Aizawa et al. ..... 399/339
5,298,917 A * 3/1994 Deguchi et al. ..... 347/138

FOREIGN PATENT DOCUMENTS

JP 1-29815 9/1989
JP 3093658 2/2003

* cited by examiner

*Primary Examiner*—David M. Gray
*Assistant Examiner*—Ryan D. Walsh
(74) *Attorney, Agent, or Firm*—Banner & Witcoff, Ltd.

(57) ABSTRACT

An image recording apparatus including: upper and lower unit cases; a stand member having first and second end portions, the first end portion attached to one of the upper unit case and the lower unit case; a guide member attached to the other of the upper unit case and the lower unit case in a manner that the guide member is positioned at a first position during a closing motion and is positioned at a second position during an opening motion, the guide member guiding the second end portion of the stand member; and a constraint portion disposed on the other of the upper unit case and the lower unit case, the constraint portion providing a frictional resistance on at least one of the guide member and the second end portion of the stand member when the guide member is at the first position.

20 Claims, 16 Drawing Sheets

IMAGE RECORDING APPARATUS AND OPENING AND CLOSING MECHANISM

BACKGROUND OF THE INVENTION

1. Field of the Invention

The present invention relates to an image recording apparatus, such as a printer, a facsimile or a copier. The invention particularly relates to an image recording apparatus in which an upper unit case having an original reading portion is attached to be rotationally openable or closable to a lower unit case having a sheet feed portion and a recording portion, and in which the upper unit case can be slowly closed.

2. Description of the Related Art

Conventionally, various mechanisms have been proposed in which one side of the upper unit case is attached to be rotationally openable or closable via a hinge to a lower unit case, whereby the upper unit case is kept widely opened when conducting maintenance or paper jam handling.

For instance, Japanese Utility Model Registration No. 3093658 (see FIGS. 1 and 2) discloses a mechanism in which a stand member rotatably secured to a lower face of an upper unit case is faced within a receiving opening formed in an upper face of a lower unit case. Engaging claws provided on the bottom of the stand member are engaged at an edge of the receiving opening, so that the upper unit case is kept in an attitude at a constant opening angle. An elastic member provided on the lower side of the stand member is resiliently pressed around the edge of the receiving opening, whereby the rotation of the upper unit case is braked in an area where the upper unit case begins to be closed or ends to be opened.

With this configuration, the brake (braking) is not applied in a closing end area where the upper unit case approaches the lower unit case, so that the upper unit case may be rapidly closed to undergo a great impact.

In order to solve this problem, JP-UM-B-1-29815 (see FIGS. 3 and 6) discloses a mechanism in which an arcuate guide member (guiding member) projecting downwards on a side face of an upper unit case (cover) is formed with an arcuate guide groove. A shaft of a bolt at one side of a lower unit case (housing) is inserted through the guide groove, and the upper unit case is held in position at any rotation angle by clamping the guide member between a head of the bolt and a spring member. The upper unit case is urged upwards by a torsion spring disposed in the lower unit case at a closed position where the upper unit case is closed on the lower unit case.

SUMMARY OF THE INVENTION

However, in JP-UM-B-1-29815, the upper unit case is urged upwards only at the closed position, and is stopped at any opening angle. Thus, it is required to apply a great force when the upper unit case is rotated in the closing or opening direction.

The present invention provides an image recording apparatus in which a closing operation of a pair of unit cases is constrained to prevent impact from being exerted on the unit cases, and in which an opening operation of the pair of unit cases is smoothly performed.

According to one aspect of the invention, there is provided an image recording apparatus including: an upper unit case; a lower unit case; a hinge portion that connects the upper unit case and the lower unit case to be rotationally openable and closable; a stand member having a first end portion and a second end portion, the first end portion being pivotably attached to one of the upper unit case and the lower unit case; a guide member attached to the other of the upper unit case and the lower unit case in a manner that the guide member is positioned at a first position during a closing motion of the upper unit case or the lower unit case and the guide member is positioned at a second position during an opening motion of the upper unit case or the lower unit case, the guide member guiding the second end portion of the stand member; and a constraint portion disposed on the other of the upper unit case and the lower unit case, the constraint portion providing a frictional resistance on at least one of the guide member and the second end portion of the stand member when the guide member is at the first position.

According to another aspect of the invention, there is provided an opening and closing mechanism that connects first and second unit cases to be rotationally openable and closable, including: a stand member having a first end portion and a second end portion, the first end portion being pivotably attached to one of the upper unit case and the lower unit case; a guide member attached to the other of the upper unit case and the lower unit case in a manner that the guide member is positioned at a first position during a closing motion of the upper unit case or the lower unit case and the guide member is positioned at a second position during an opening motion of the upper unit case or the lower unit case, the guide member guiding the second end portion of the stand member; and a constraint portion disposed on the other of the upper unit case and the lower unit case, the constraint portion providing a frictional resistance on at least one of the guide member and the second end portion of the stand member when the guide member is at the first position.

With the above configuration, only when the upper unit case or the lower unit case is in the closing operation, a constraining action is exhibited so that it can be closed slowly. On the other hand, when the upper unit case or the lower unit case is opened, little constraint is applied, so that it can be smoothly opened.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
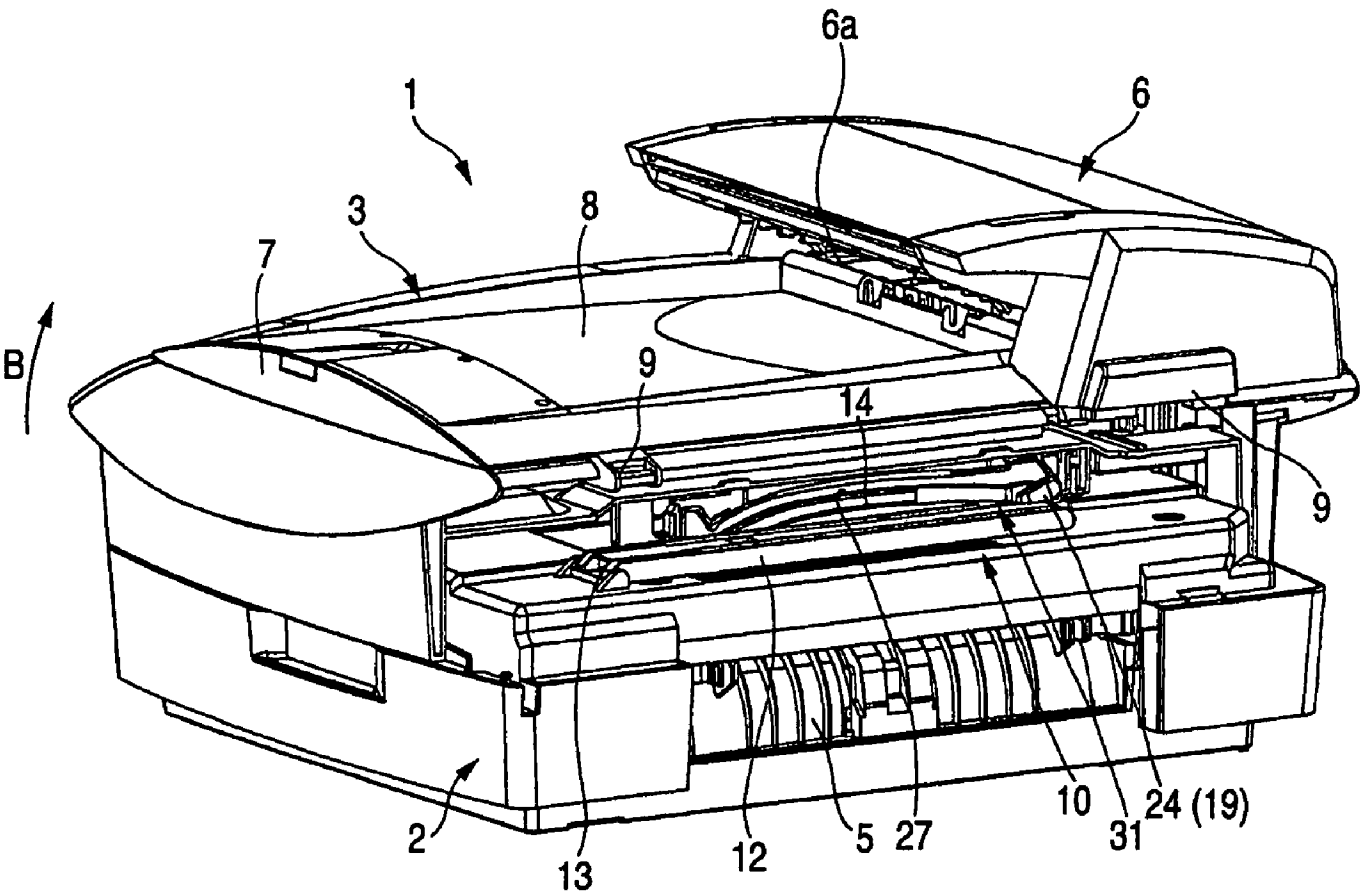
FIG. 1 is a partially cutaway rear perspective view showing a multifunction device according to an embodiment of the invention, in a state where an upper unit case is closed on a lower unit case.
Figure 2:
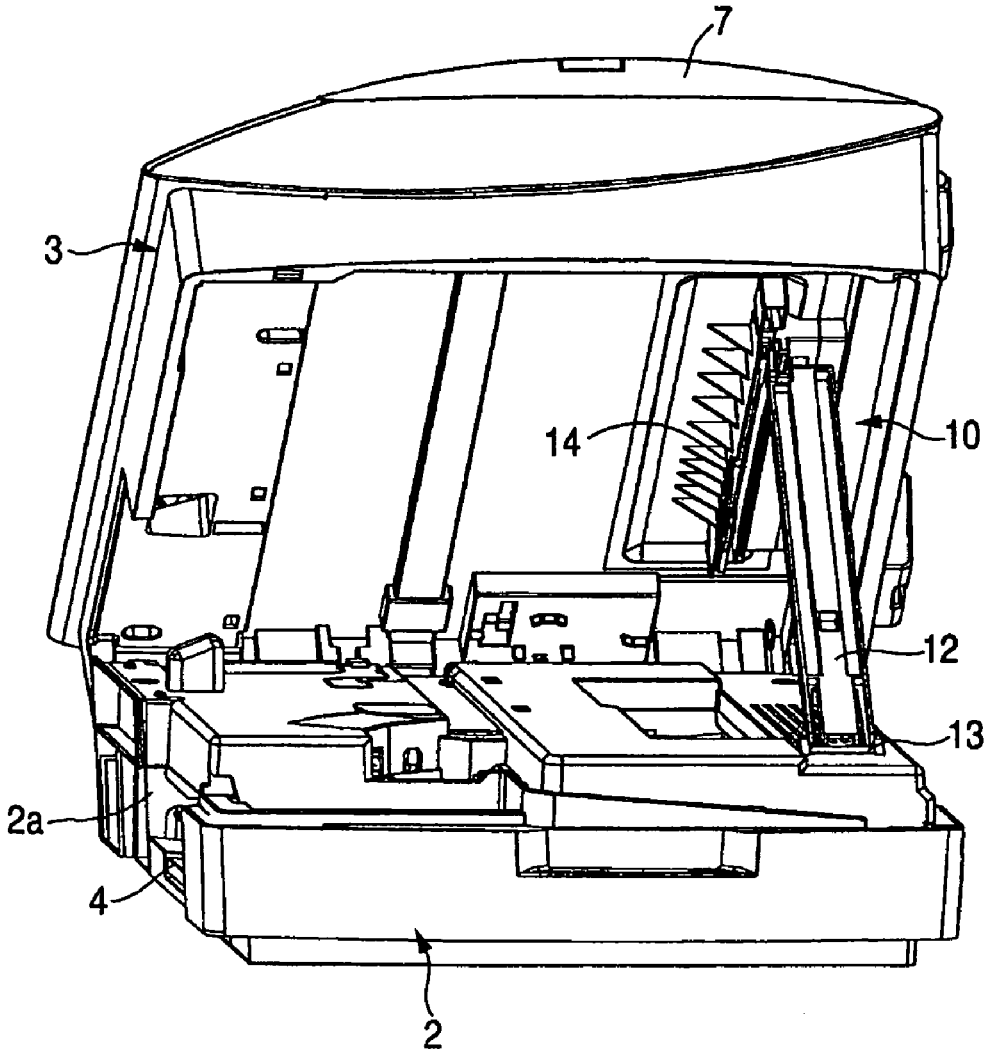
FIG. 2 is a side perspective view in a state where the upper unit case is widely opened relative to the lower unit case.

An image recording apparatus 1 of this embodiment is a multifunction device (MFD) having a printer function, a copier function, a scanner function and a facsimile function. A sheet feed cassette 4 is inserted through an opening portion 2*a* on a front side (left side in FIG. 2) of a lower unit case 2 made of synthetic resin, as shown in FIGS. 1 and 2. This opening portion 2*a* is partitioned into upper and lower portions. The upper portion functions as a sheet discharge portion. For the sake of convenience, the side where the opening portion 2*a* is located is called the front side, and the opposite side farthest away from the opening portion 2*a* is called the rear side (back side).

A recording portion of inkjet type (not shown) is disposed above the sheet feed cassette 4 within the lower unit case 2, to which a sheet (recording medium) fed from the sheet feed cassette 4 is transported while being U-turned via a transport passage member 5 that is detachably attached to the rear side of the recording portion. The recorded sheet is discharged through the opening portion 2*a* that is above the sheet feed cassette 4.

The upper unit case 3 attached to be openable and closable to the lower unit case 2 is provided with an automatic original feeding device 6 (see FIGS. 1 and 2) and an image reading device (not shown) for reading the original in the copier function and the facsimile function. Also, an operation panel (not shown) having various kinds of operation buttons and a liquid crystal display is disposed on the upper unit case 3.

On the upper face of an original cover body 7 that covers the upper face of an original placing glass plate (not shown) in the image reading device 1, the automatic original feeding device 6 and an original discharge portion 8 for placing the original discharged from an exit 6*a* of the automatic original feeding device 6 are provided. The original cover body 7 is vertically rotatable about a hinge 9 disposed on the rear side of the image reading apparatus (at a front end part in FIG. 1). An image scanner device (CIS: Contact Image Sensor) for reading the original is provided to be able to reciprocate in the left and right direction of FIG. 1 on the lower side of the original placing glass plate so as to read an image.

Figure 4:
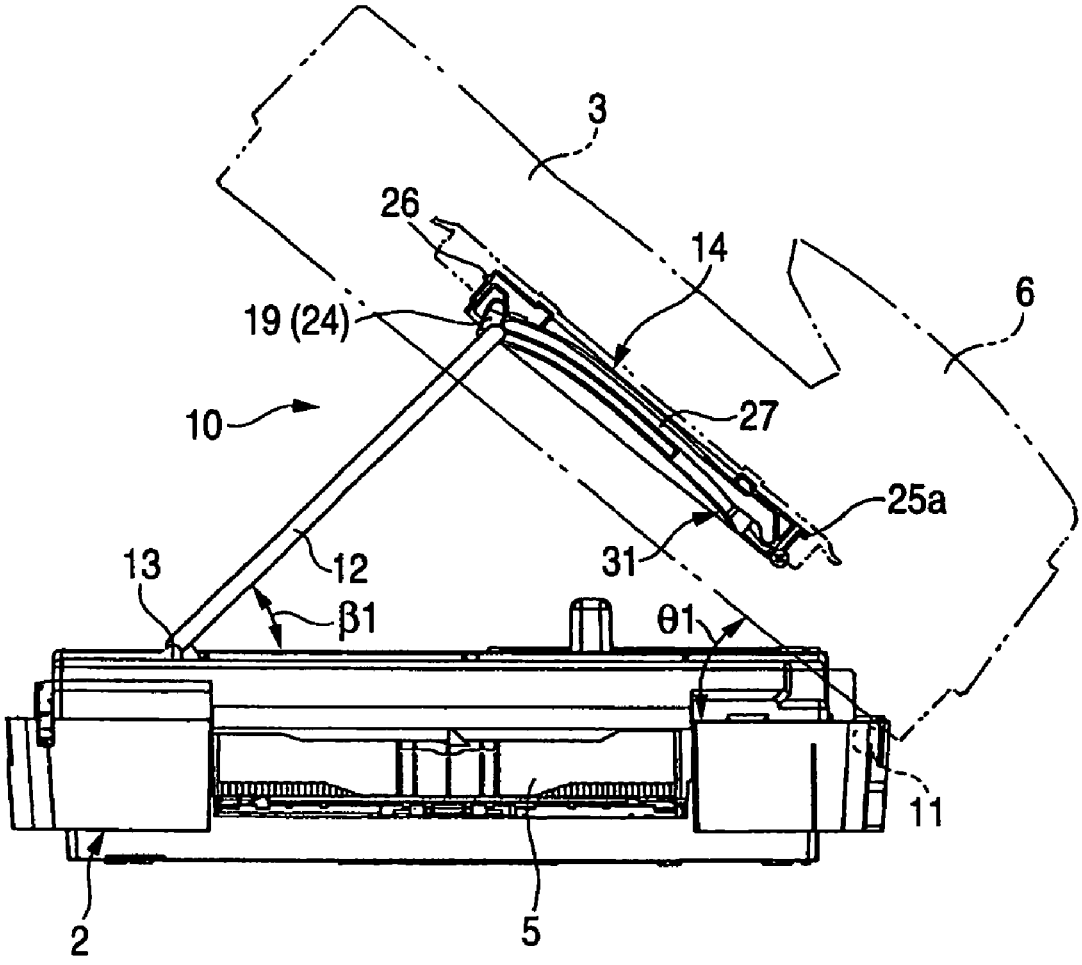
FIG. 4 is a rear view of an opening and closing mechanism in a state where the upper unit case is widely opened relative to the lower unit case.
Figure 5A:
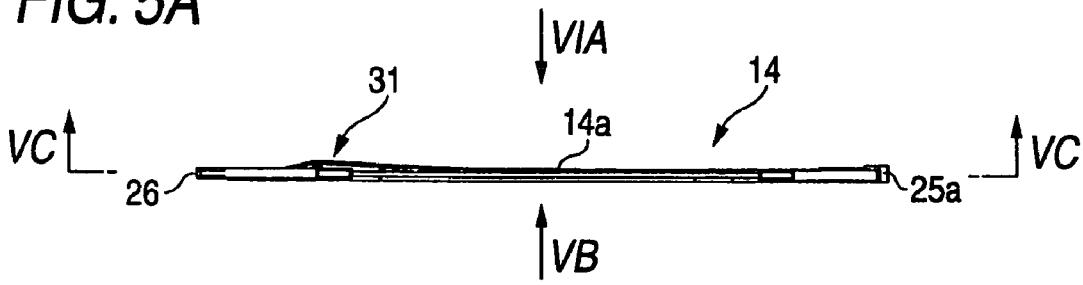
FIG. 5A is a plan view of a guide member.
Figure 5B:
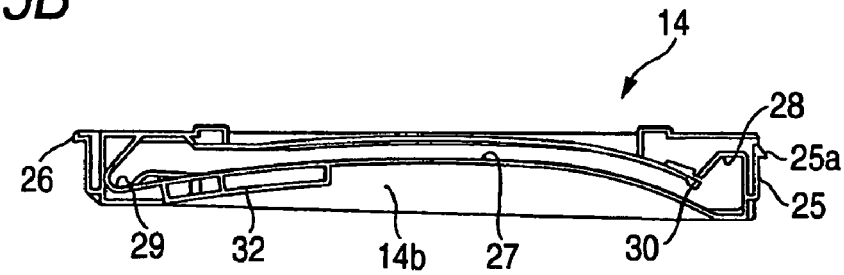
FIG. 5B is a side view as seen from a direction of arrow VB in FIG. 5A.
Figure 5C:
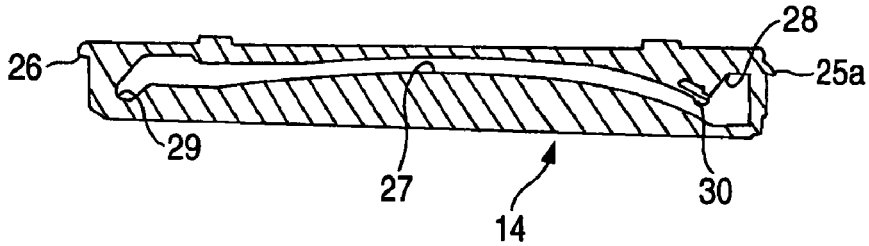
FIG. 5C is a sectional view taken along line VC-VC in FIG. 5A and showing a longitudinal guide groove of the guide member.

Subsequently, an opening and closing mechanism 10 for enabling the lower unit case 2 and the upper unit case 3 to be opened and closed will be described. In this image recording apparatus 1, the upper unit case 3 rotates relative to the lower unit case 2 in a direction of arrow B in FIG. 1. Specifically, the side of the upper unit case 3 farthest away from the automatic original feeding device 6 is widely opened upwards via a hinge 11 disposed at a right end in FIG. 4. As shown in FIG. 4, a guide member 14 is attached to the upper unit case 3. The guide member 14 has an arcuate, longitudinal guide groove 27. A stand member 12 is provided in a manner that its stand angle β1 relative to the upper face of the lower unit case 3 is changeable. One end (distal end part) of the stand member 12 is connected to the upper unit case 3 in a slidable manner, and the other end (base end part) of the stand member 12 is pivotably attached to the lower unit case 2. The base end part of the stand member 12 is attached pivotably via a pivot portion 13 at a position farther away from the hinge 11 on the upper face of the lower unit case 2. In accordance with the opening and closing motion of the upper unit case 3, a projecting arm portion 19 at the distal end part of the stand member 12 is guided along the guide groove 27 of the guide member 14.

As shown in FIG. 1, The opening and closing mechanism 10 of this embodiment has the stand member 12 and the guide member 14 disposed between the upper face of the lower unit case 2 on the rear side of the image recording apparatus 1 and the lower face of the upper unit case 3. Also, a constraint portion 22 is formed on the lower face side of the upper unit case 3.

Figure 3A:
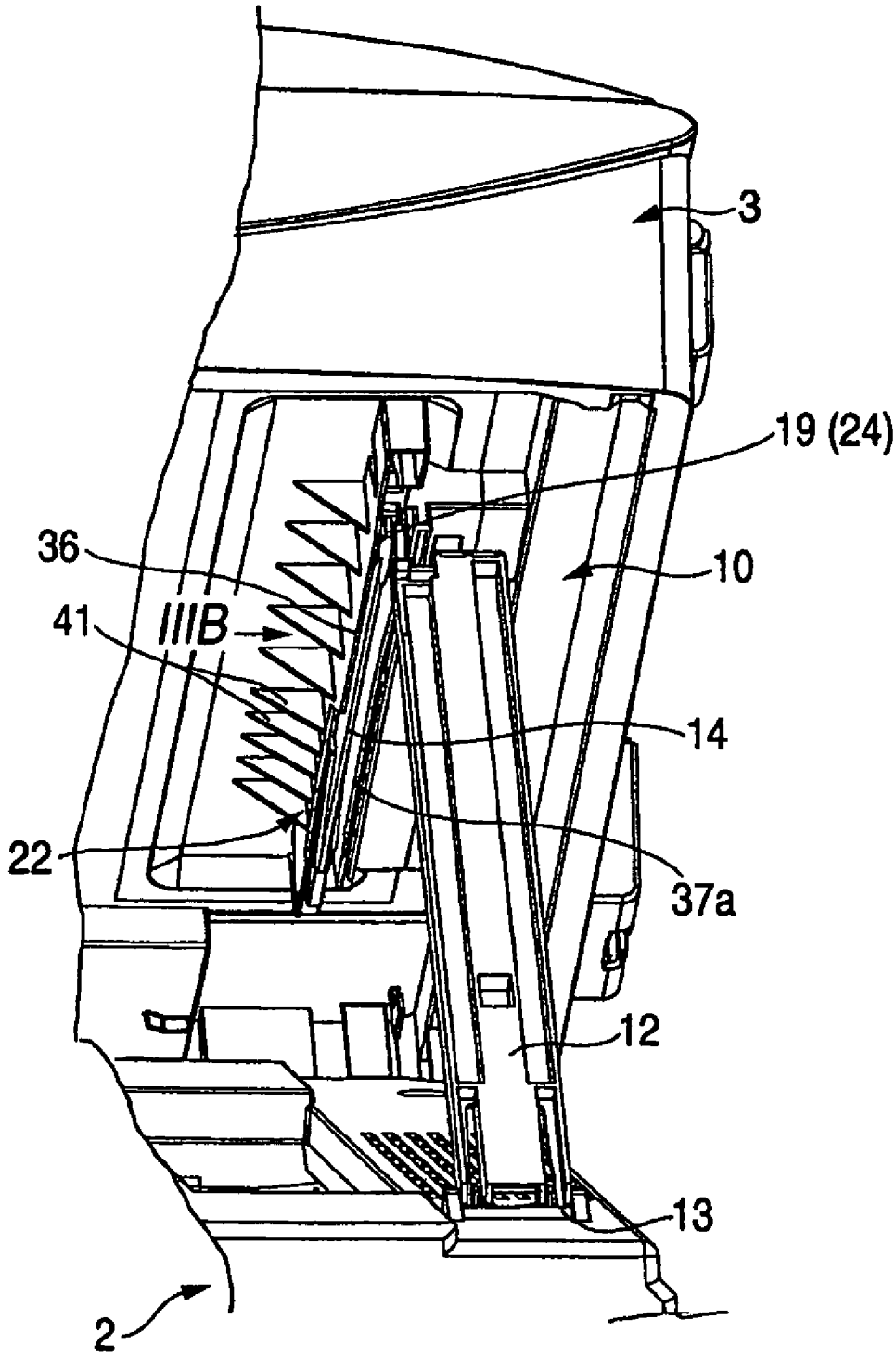
FIG. 3A is an enlarged perspective view of FIG. 2.

As shown in FIG. 3A, the constraint portion 22 has a pair of wall members 36, 37*a*. Plural deformation preventing ribs 41 support the wall member 36. The guide member 14 is attached between the pair of wall members 36, 37*a*. Between one end (top end in FIG. 3A) of the guide member 14 and the wall member 37*a*, the projecting arm portion 19 at the distal end part of the stand member 12 is inserted. As the upper unit case 3 is closed, the projecting arm portion 19 moves towards the other end (lower end in FIG. 3A) of the guide member 14 and thus the stand member 12 gradually falls. During this closing operation, friction resistance is exerted on the projecting arm portion 19, the guide member 14 and the constraint portion 22, whereby the closing motion of the upper unit case 3 is constrained.

Figure 3B:
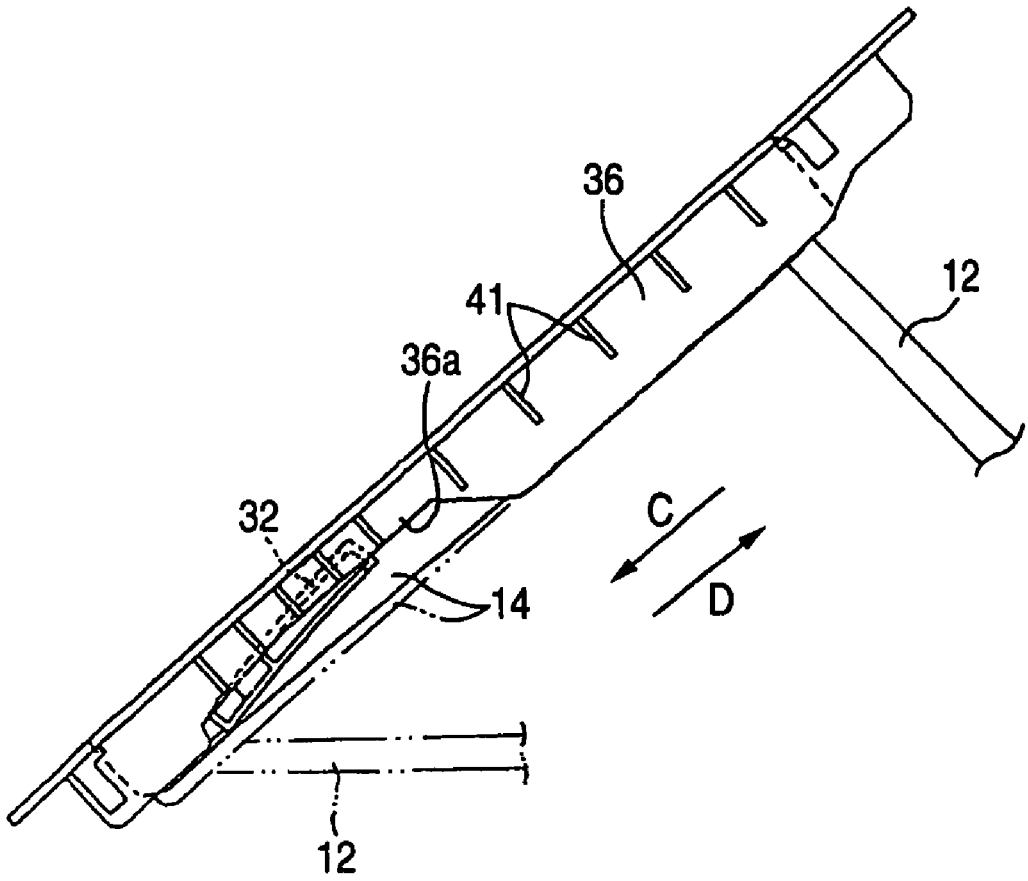
FIG. 3B is a view as seen from a direction of arrow IIIB in FIG. 3A.

FIG. 3B is a view as seen from a direction of arrow IIIB in FIG. 3A. The wall member 36 is notched to provide a lower wall portion 36*a*. One side face of the guide member 14 has a reinforcing rib 32 that projects in a direction perpendicular to the sheet of FIG. 3B towards the lower wall portion 36*a*. The other side face of the guide member 14 has a load applying portion that will be described later in detail. The load applying portion is located at a position corresponding to the reinforcing rib 32 on the opposite side face of the guide member 14 and is projecting opposite to the reinforcing rib 32 towards the wall member 37*a*. During the closing motion of the upper unit case 3, most of the reinforcing rib 32 is positioned inside the lower wall portion 36*a* as shown in FIG. 3B. As the upper unit case 3 is closed, the stand member 12 moves in a direction of arrow C, and when the projecting arm portion 19 enters a gap between the load applying portion and the wall member 37, the guide member 14 is pressed towards the wall member 36 or the lower wall portion 36*a*. At this time, since most of the reinforcing rib 32 is positioned inside the lower wall portion 36*a* and abuts the lower wall portion 36*a*, the displacement or deformation of the guide member 14 towards the wall member 36 is constrained. Therefore, high friction resistance is exerted on the projecting arm portion 19, the guide member 14 and the constraint portion 22, which constrains the closing motion of the upper unit case 3.

On the other hand, during the opening motion of the upper unit case 3, as shown in FIG. 3B by chain double-dashed lines, the guide member 14 slightly moves downwards relative to the wall member 36 and most of the reinforcing rib 32 is exposed below the lower wall portion 36*a*. As the upper unit case 3 is opened, the stand member 12 moves from the bottom end of the guide member 14 in a direction of arrow D. The projecting arm portion 19 of the stand member 12 then enters in the gap between the load applying portion and the wall member 37*a*, and presses the guide member 14 towards the wall member 36. At this time, since most of the reinforcing rib 32 does not abut on the lower wall portion 36*a*, the guide member 14 moves towards the wall member 36 side. Therefore, the friction resistance caused among the projecting arm portion 19, the guide member 14 and the constraint portion 22 is small, and thus the opening operation of the upper unit case 3 can be smoothly performed.

Figure 9:
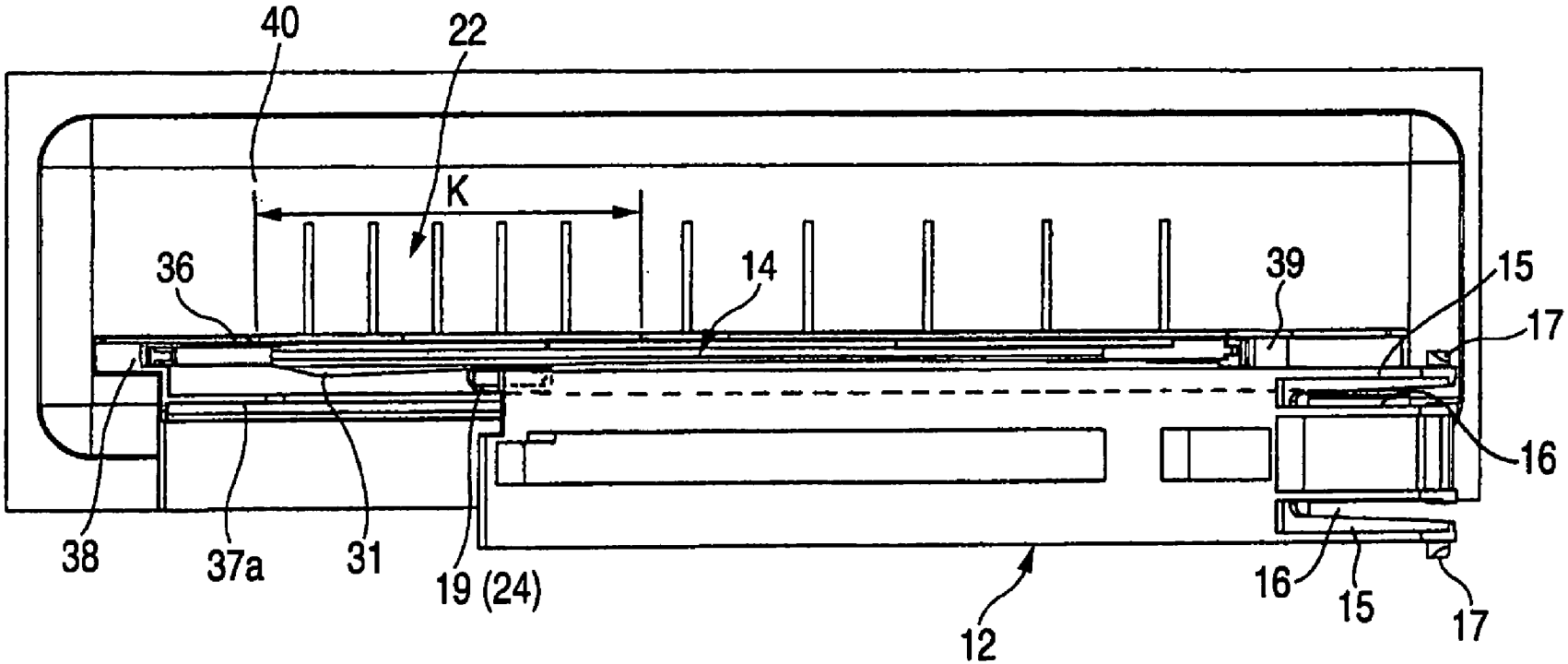
FIG. 9 is a bottom view as seen from line IX-IX in FIG. 7A.

The stand member 12 and the guide member 14 are molded products made of synthetic resin. The stand member 12 is slender and flat. At the base end part of the stand member 12, a pair of elastic pieces 15 are integrally provided via a pair of notch portions 16. At the tip ends of both elastic pieces 15, securing pins 17 projecting outwards from each other are formed, as shown in FIGS. 3A and 9. By narrowing the distance at the tip ends between both elastic pieces 15, a pair of securing pins 17 can be resiliently fitted into the pivot portion 13. The projecting arm portion 19 at the distal end part of the stand member 12, has a rotatable guide roll that is a guided portion 20 fitted and guided in the almost arcuate, longitudinal guide groove 27 bored in the guide member 14 (see FIGS. 11, 12A and 12B), as will be described later. Instead of this guide roll, the guided portion 20 may be a guide pin formed in a round stem. The width size of the longitudinal guide groove 27 is formed slightly larger than the diameter of the rotatable guide roll that is the guided portion 20, and the guided portion 20 has a small resistance and is slidable.

Figure 11:
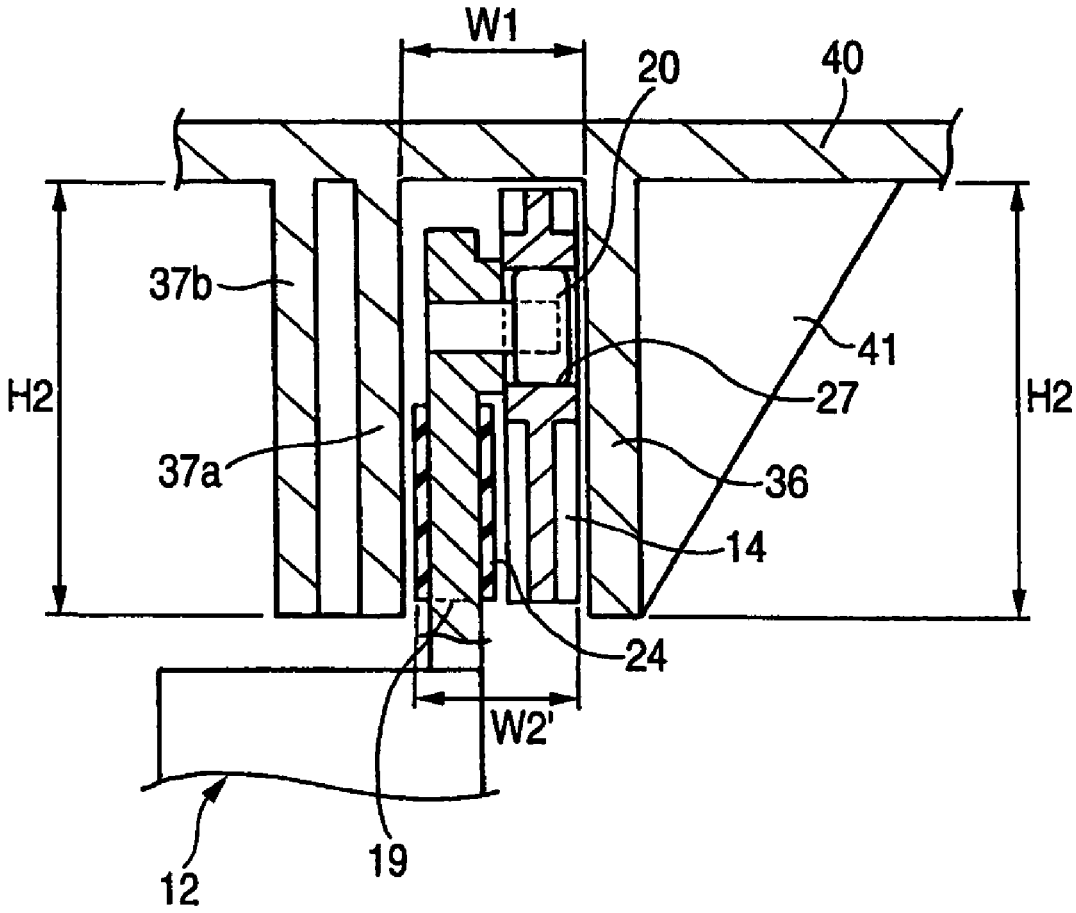
FIG. 11 is an enlarged cross-sectional view showing essential parts of the upper unit case at a wide opened position.
Figure 12A:
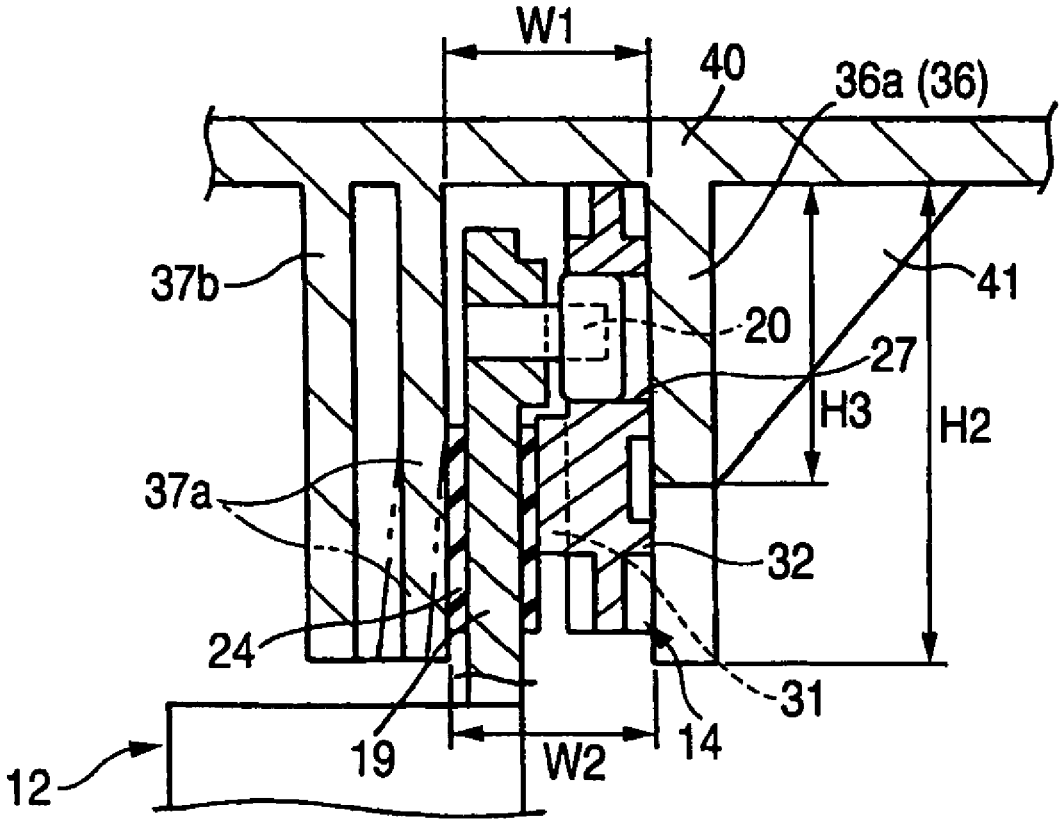
FIG. 12A is an enlarged cross-sectional view as seen from line XIIA-XIIA in FIG. 7A.
Figure 12B:
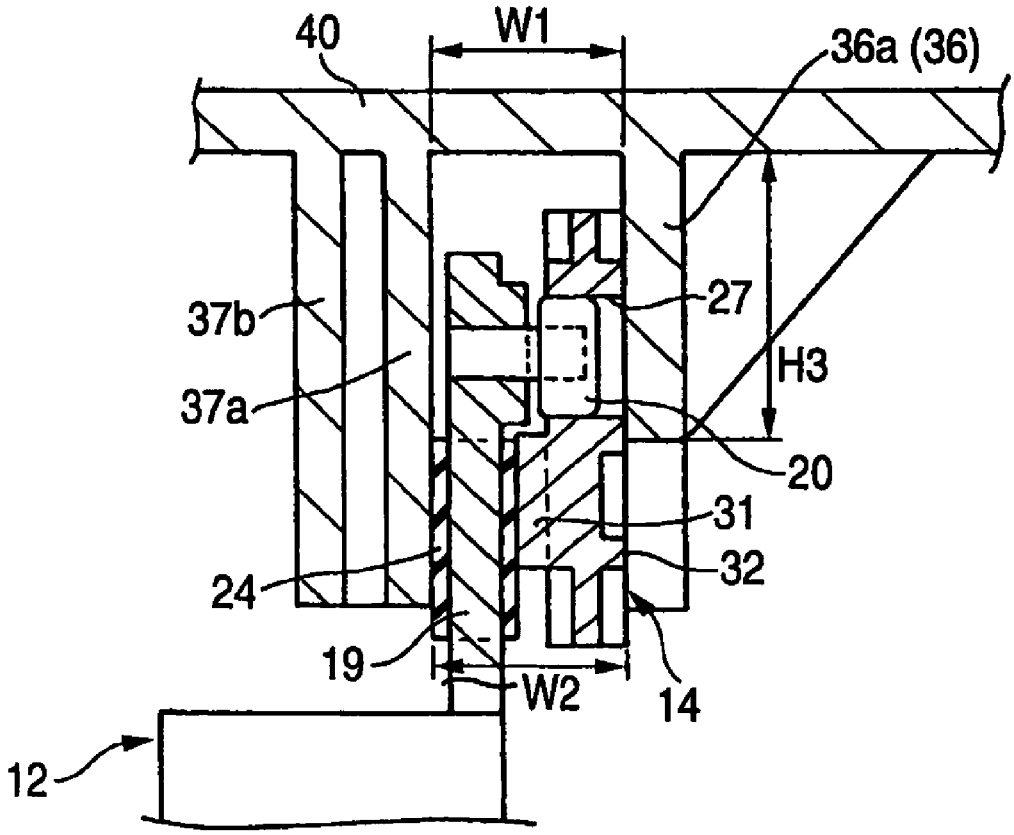
FIG. 12B is an enlarged cross-sectional view as seen from line XIIB-XIIB in FIG. 8A.

A frictional sliding member 24 having a high friction coefficient such as rubber is fixed on at least one face (all peripheral faces including opposing faces in this embodiment) of the projecting arm portion 19 (see FIGS. 11, 12A and 12B). This frictional sliding member 24 may be bonded by adhesives.

The guide member 14 is substantially a flat plate, and formed longitudinally in a direction along a rotation locus of the distal end part of the stand member 12, as shown in FIGS. 5A to 5C and FIGS. 6A to 6C. At one end of the guide member 14 in the longitudinal direction, an engaging claw 25*a* is provided via a resilient piece 25. The engaging claw 25*a* serves as a movement reference position when the stand member 12 attached on the lower face of the upper unit case 3 is moved along a plane including the rotation locus. At the other end of the guide member 14 in the longitudinal direction, a projection piece 26 supported on an end wall 38 is provided to limit the movement range when the stand member 12 is moved along the plane including the rotation locus.

The almost arcuate, longitudinal guide groove 27 that extends longitudinally in the direction along the rotation locus is provided inside the guide member 14. At one end of this longitudinal guide groove 27, a short engagement groove 28 is provided to communicate with the longitudinal guide groove 27 in a direction crossing the longitudinal direction of the guide groove 27. Also, at the other end of the longitudinal guide groove 27, a short closed position holding groove 29 extending in a direction opposite to the direction in which the engagement groove 28 extends is provided to communicate with the longitudinal guide groove 27. A connection area between the engagement groove 28 and the longitudinal guide groove 27 is provided with a resilient convex piece 30 for giving a tactile response to a user when the guided portion 20 passes therethrough.

Figure 6A:
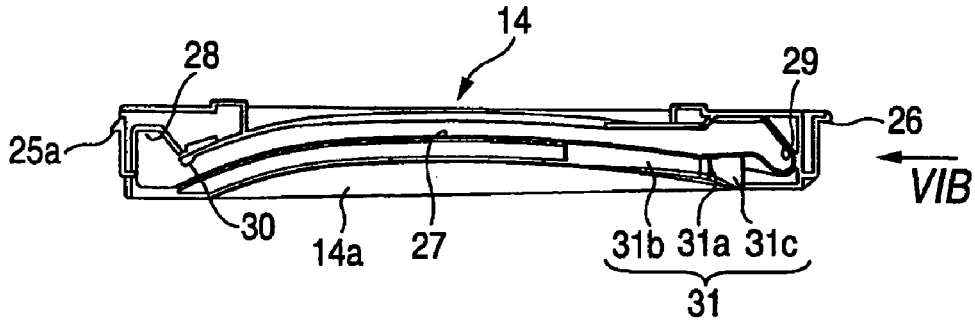
FIG. 6A is a side view of the stand member as seen from a direction of arrow VIA in FIG. 5A.
Figure 6B:
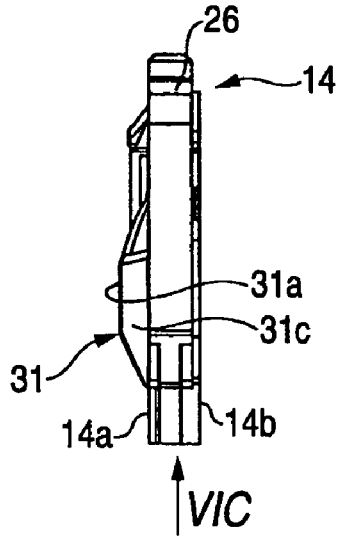
FIG. 6B is a side view as seen from a direction of arrow VIB in FIG. 6A.
Figure 6C:
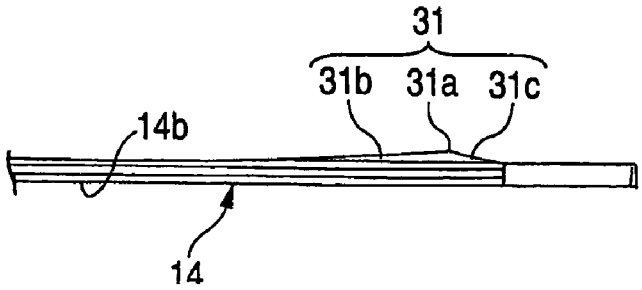
FIG. 6C is a bottom view as seen from a direction of arrow VIC and showing a load applying portion.

Moreover, as shown in FIG. 6A, on one side face 14*a* (a face opposed to the projecting arm portion 19 of the stand member 12) of the guide member 14, the load applying portion 31 extending along a radially inward region of the longitudinal guide groove 27 is integrally formed. This load applying portion 31 is formed almost concentrically with an arc of the longitudinal guide groove 27 in a region near the closed position holding groove 29. As shown in FIG. 6C, the load applying portion 31 is formed as an obtuse-angled triangle that projects in a direction of thickness of the guide member 14. More particularly, the shape of this load applying portion 31 is such that an inclined face of the region closer to the closed position holding groove 29 than a vertex 31*a* is a steep slope 31*c*, and the opposite side is a gentle slope 31*b*.

On the other side face 14*b* (side face without the load applying portion 31) of the guide member 14, an arcuate reinforcing rib 32 having the almost same radius as the load applying portion 31 is integrally protruded at a position on the back face opposed to the load applying portion 31.

A pair of end walls 38, 39 connect both ends of the wall members 36, 37*a* (see FIG. 9). The wall members 36, 37*a* are connected to a ceiling plate 40. Between each upper end of the end walls 38, 39 and the ceiling plate 40, a gap is defined. The projection piece 26 and the engaging claw 25*a* are inserted into the gaps, respectively.

Figure 7A:
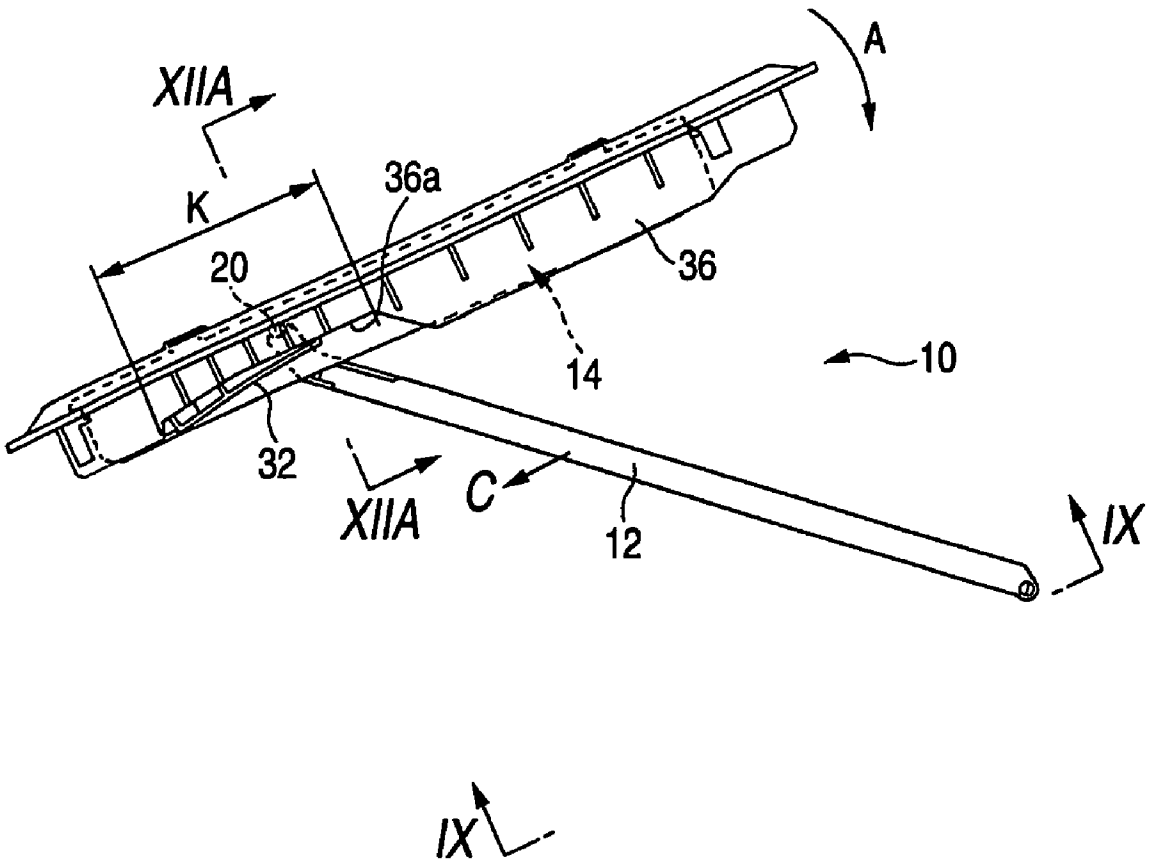
FIGS. 7A and 7B are explanatory views showing an operation of the opening and closing mechanism in a state where the upper unit case is being rotated in a closing direction.
Figure 7B:
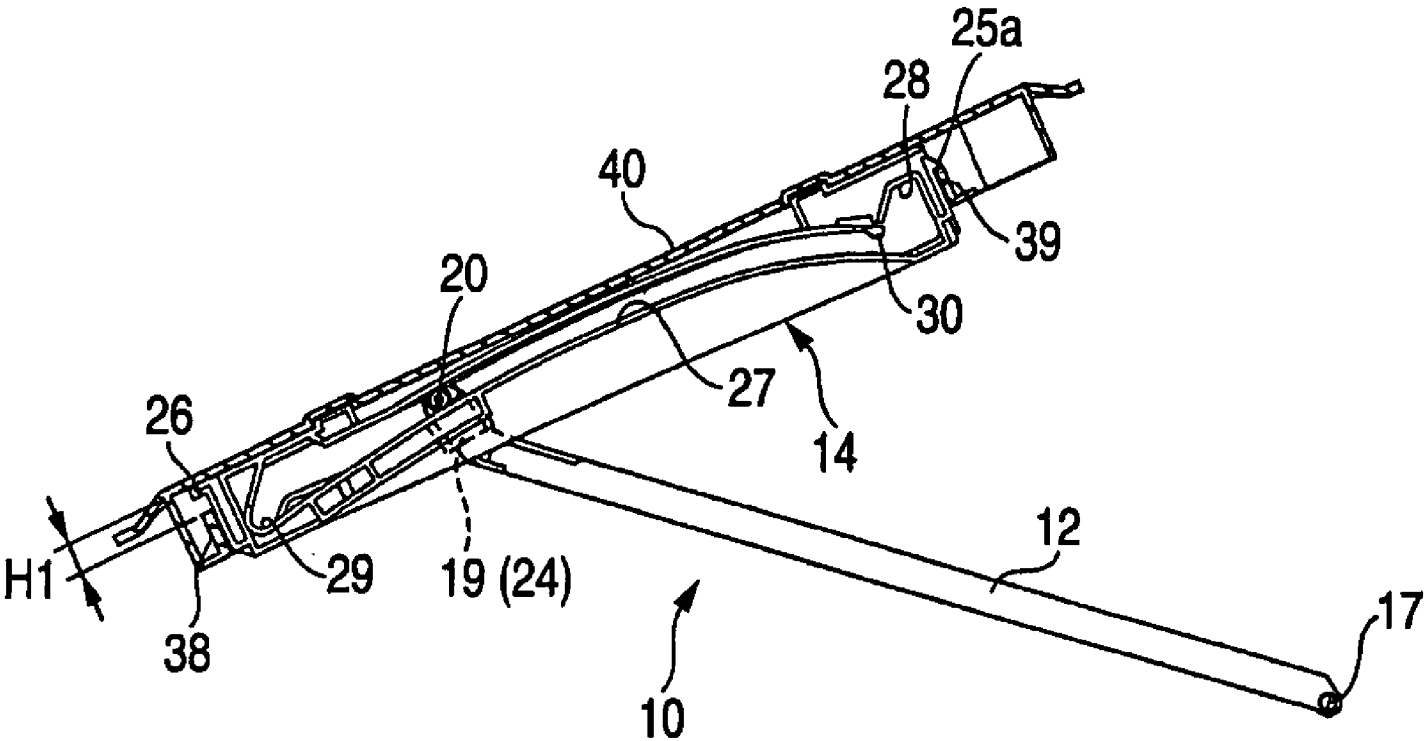
Figure 8A:
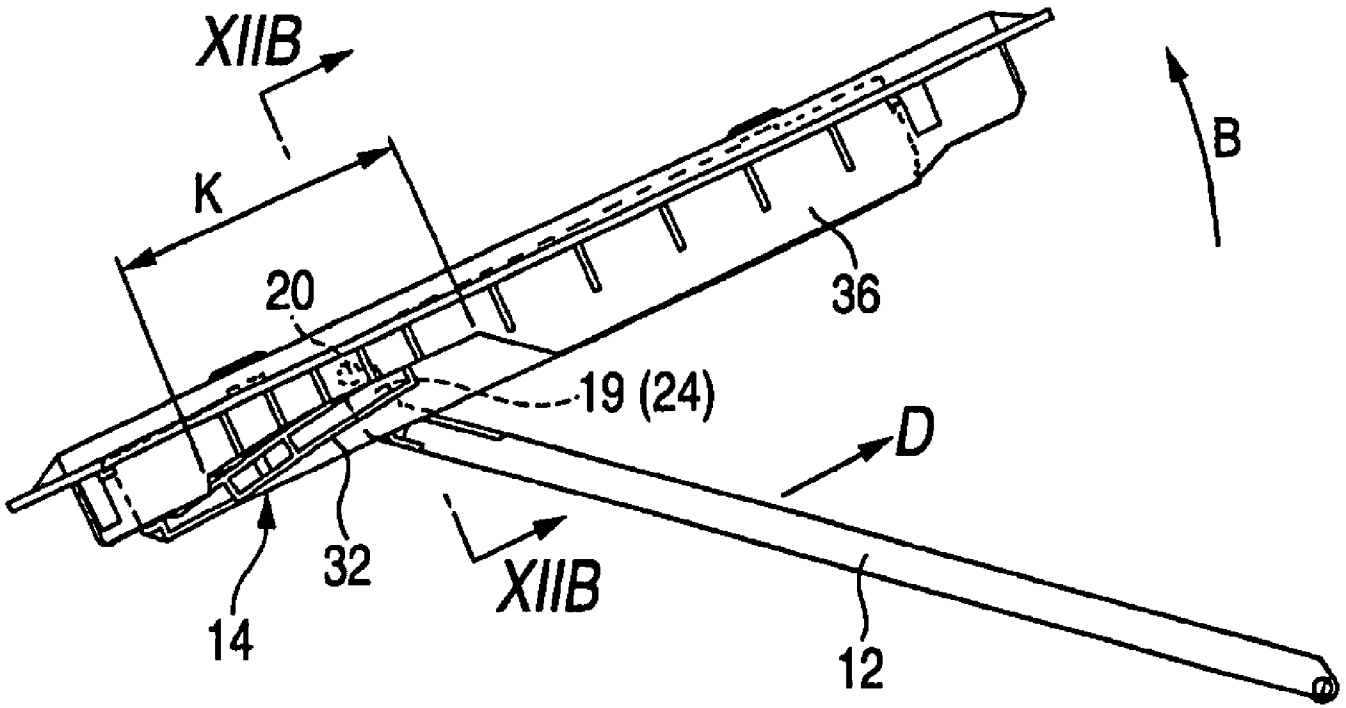
FIGS. 8A and 8B are explanatory views showing an operation of the opening and closing mechanism in a state where the upper unit case is being rotated in an opening direction.
Figure 8B:
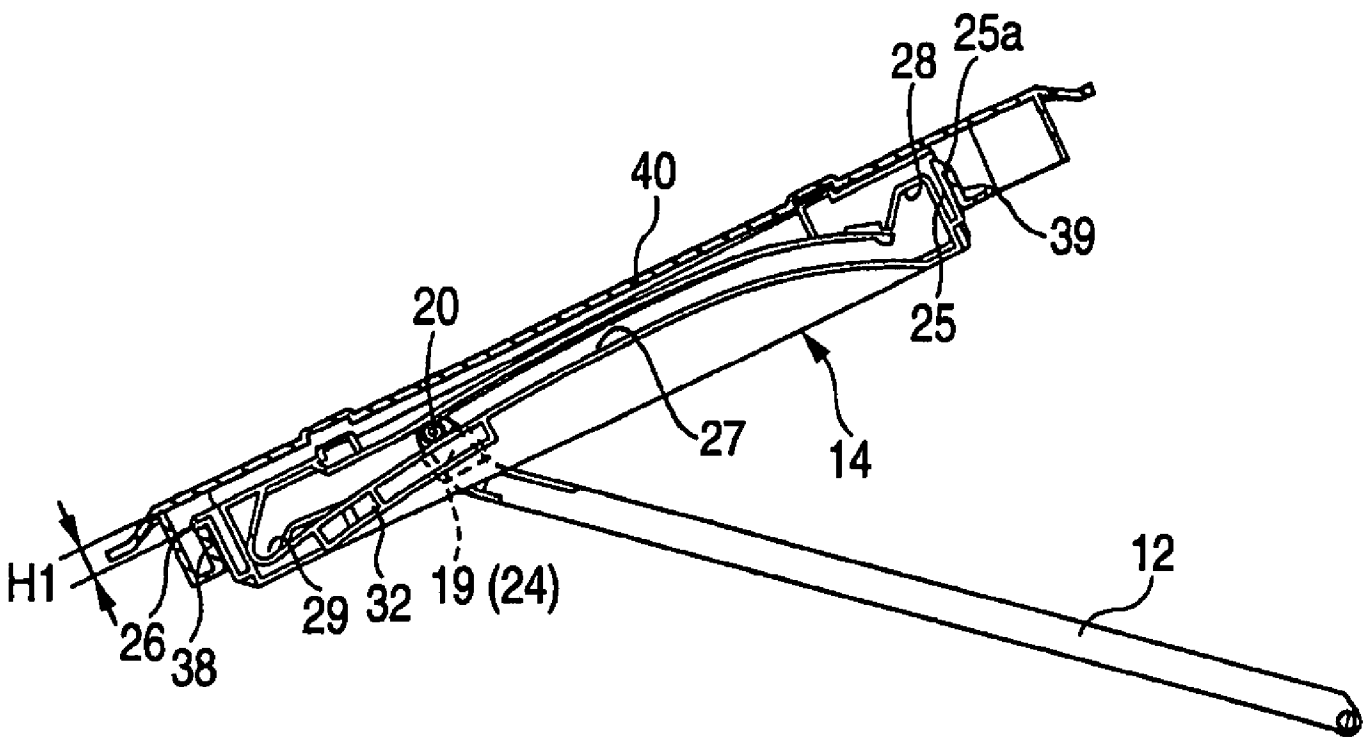

As shown in FIGS. 7B and 8B, the engaging claw 25*a* is fitted in the gap between the end wall 39 and the ceiling plate 40 in a manner that the guide member 14 can be scarcely moved vertically at this region. This region serves as a rotation center. On the other hand, the projecting piece 26 is fitted in the gap between the end wall 38 and the ceiling plate 40, and the swinging tip end of the rotating guide member 14 is vertically movable by the distance H1 subtracted by the width of the projecting piece 26 (see FIG. 8B).

Figure 10:
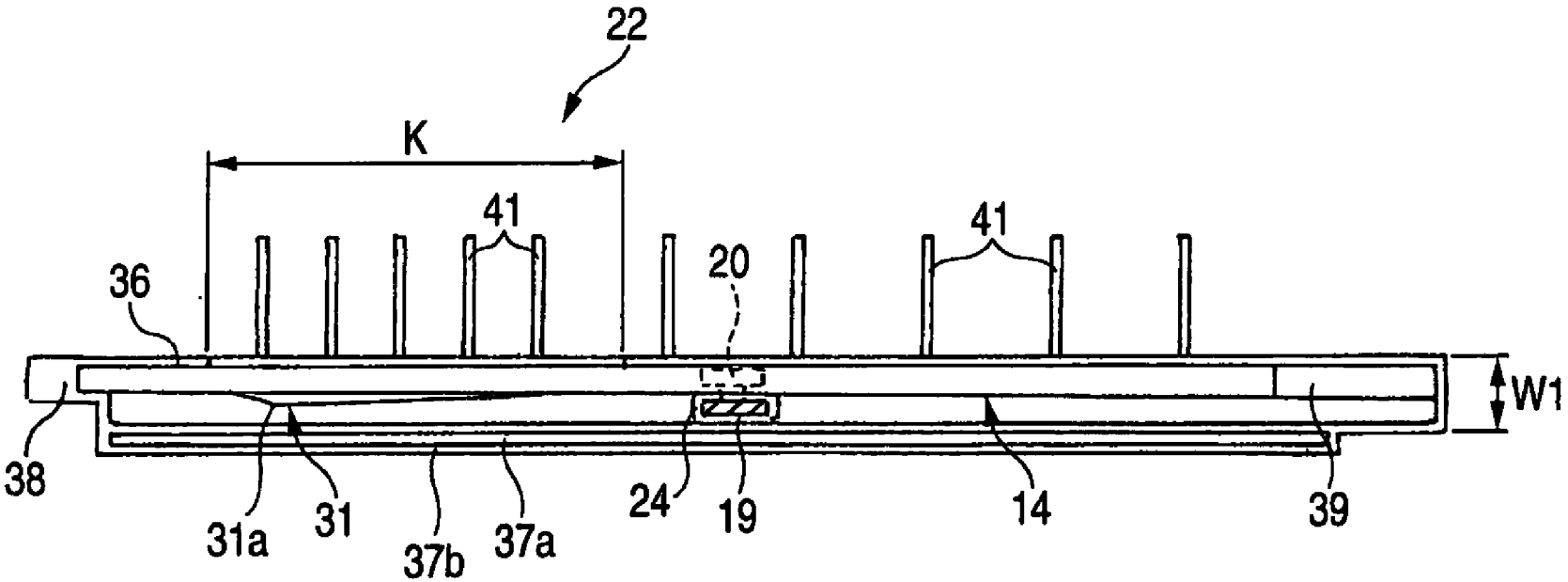
FIG. 10 is a bottom view showing essential parts of the opening and closing mechanism shown in FIG. 9.

The heights H2 of the pair of wall members 36, 37*a* from the lower face of the ceiling plate 40 are set to be almost the same. In this embodiment, the first wall member 36 is the wall member facing the plane having the reinforcing rib 32 of the guide member 14, and the second wall member 37*a* is the wall member facing the plane having the load applying portion 31 of the guide member 14. The plural deformation preventing ribs 41 formed almost triangular are provided to link between an outer face of the first wall member 36 and a lower face of the ceiling plate 40. The second wall member 37*a* can be elastically deformed in the direction of plate thickness, and is linked to both ends of a third wall member 37*b* stood on its back face. This provides a support beam structure where beams are bound at their both ends in the longitudinal direction (see FIG. 10).

An interval W1 of a gap between the first wall member 36 and the second wall member 37*a* is slightly larger than the total thickness W2' of a region of the guide member 14 where the load applying portion 31 is not provided, the projecting arm portion 19 and the frictional sliding member 24, which are interposed in this gap, to the extent that the projecting arm portion 19 can move smoothly along the longitudinal direction of the guide member 14 without causing a frictional resistance (see FIG. 11). The total thickness W2 of a region of the guide member 14 where the load applying portion 31 is provided, the projecting arm portion 19 and the frictional sliding member 24 is larger than the interval W1 (see FIG. 12A). The total thickness W2 becomes the maximum at the vertex 31*a* of the load applying portion 31. In a section K corresponding to the region where the load applying portion 31 (reinforcing rib 32) of the guide member 14 is disposed is formed with a notch to have the lower wall portion 36*a* with the height H3 (see FIGS. 7A and 8A). The pair of wall members 36 (36*a*), 37*a* in this section K (also called a notch section) function as the constraint portion 22. In a state where the projecting piece 26 at the swinging tip end of the guide member 14 is moved down a distance H1 from the lower face of the ceiling plate 40, the constraint of the guide member 14 with the load applying portion 31 and the projecting arm portion 19 with the frictional sliding member 24 by the pair of wall members 36, 37*a* is released. In such a state, the height H3 of the section K is set such that the frictional resistance caused when the projecting arm portion 19 is moved along the load applying portion 31 of the guide member 14 becomes small.

Subsequently, the action of the opening and closing mechanism 10 with the above constitution will be described. In a state where the upper unit case 3 is opened relative to the lower unit case 2 at the maximum angle θ1 (acute angle) as shown in FIG. 4, the stand member 12 is stood from the upper face of the lower unit case 2 at the angle of β1 (acute angle). In this state, the guided portion 20 is fitted into an upper end of the engagement groove 28 at one end of the longitudinal guide groove 27 (on the side farther away from the hinge 11, or the side closer to the free end of the upper unit case 3) in the guide member 14, so that the maximum open attitude is kept.

To close the upper unit case 3, the user raises the free end of the upper unit case 3 by one hand slightly, and presses down the stand member 12, so that the guided portion 20 is fitted into the longitudinal guide groove 27. In this state, the user unhands the upper unit case 3, so that the upper unit case 3 is rotated downwards due to its self weight (in a direction of arrow A in FIG. 7A), and the guided portion 20 of the stand member 12 is moved from one end of the longitudinal guide groove 27 to the other end (side closer to the hinge 11), while pressing down the stand member 12 (see the arrow C in FIG. 7A).

At this time, due to an upward reaction force of the guided portion 20, the guide member 14 is pushed against the lower face of the ceiling plate 40, causing this guide member 14 to be rotated upwards about the engaging claw 25. Thus, the upper face of the guide member 14 comes in contact with the lower face of the ceiling plate 40, and the projecting piece 26 of the guide member 14 is held afloat from the end wall 38. This state is sustained until the upper unit case 3 is completely closed on the lower unit case 2 (see FIGS. 7A and 7B). Accordingly, the lower face of the guide member 14 and the lower faces of one pair of wall members 36, 37*a* are parallel, and most of the load applying portion 31 (reinforcing rib 32) is put between the pair of wall members 36 (36*a*), 37*a* in the constraint portion 22.

In a region before the projecting arm portion 19 enters a site of the load applying portion 31 on the side face of the guide member 14, the interval W1 of the gap between the first wall member 36 and the second wall member 37*a* is slightly larger than the total thickness W2' of the guide member 14, the projecting arm portion 19 and the frictional sliding member 24 (see FIG. 11). Thus, the frictional sliding member 24 is less likely to brought into contact with the second wall member 37*a*, so that the projecting arm portion 19 can move smoothly.

When the projecting arm portion 19 with the frictional sliding member 24 enters the site of the load applying portion 31 (see FIGS. 7A and 7B), in its beginning section (gently inclined face 31*b*), the interval of the gap between the second wall member 37*a* and the gently inclined face 31*b* is gradually narrowed as the projecting arm portion 19 comes closer to the vertex 31*a*, so that the frictional sliding member 24 is pressed against the gently inclined face 31*b*. That is, in a site of the constraint portion 22 corresponding to the section where the load applying portion 31 is arranged in the guide member 14, the interval between the first wall member 36 (lower wall portion 36*a*) and the second wall member 37*a* tends to be widened due to the total thickness W2 of the guide member 14, the load applying portion 31, the projecting arm portion 19 and the frictional sliding member 24. Thus, the second wall member 37*a* is mainly elastically deformed (see the two-dot chain line in FIG. 12A). Since the first wall member 36 (lower wall portion 36*a*) is supported from the outside by the deformation preventing ribs 41, it is unlikely to be elastically deformed. Due to its reaction force, the frictional resistance when the frictional sliding member 24 comes in sliding contact with the gently inclined face 31*b* (and/or) the second wall member 37*a* is increased, so that the rotation speed of the upper unit case 3 in the closing direction is made slower, regardless of the self weight of the upper unit case 3. The frictional resistance at a site of the vertex 31*a* of the load applying portion 31 is maximized. As a result, since the downward movement is once stopped or decelerated in a section immediately before the upper unit case 3 is closed on the lower unit case 2, there is the effect that the upper unit case 3 gets no significant shock.

When the upper unit case 3 is pressed down after its downward rotation is once stopped at the vertex 31*a*, the guided portion 20 of the stand member 12 enters from the vertex 31*a* of the load applying portion 31 into a section of the steep slope 31*c*. Since the total thickness W2 of the guide member 14, the load applying portion 31, the projecting arm portion 19 and the frictional sliding member 24 rapidly decreases, the frictional resistance of the frictional sliding member 24 against the second wall member 37*a* and the steep slope 31 *c* suddenly decreases. When the guided portion 20 is fitted into the closed position holding groove 29 at the other end of the guide member 14, the upper unit case 3 is completely closed on the lower unit case 2.

To open the upper unit case 3, the free end of the upper unit case 3 is raised by hand (in a direction of arrow B in FIG. 8A). Thereby, due to the self weight of the guide member 14 and the stand member 12, the guide member 14 is moved down until the projecting piece 26 comes in contact with the end wall 38 at a site of the end wall 38. When the upper unit case 3 is rotated and opened, the guided portion 20 of the stand member 12 is fitted into the longitudinal guide groove 27, exerting a downward force at all the time.

In this state, most of the load applying portion 31 (reinforcing rib 32) overhangs under the lower wall portion 36*a* in the constraint portion 22, resulting in an unconstrained state, as shown in FIGS. 8A, 8B and 12B. In this situation, though the frictional sliding member 24 slides with each of the steep slope 31*c*, the vertex 31*a* and the gently inclined face 31*b* to cause a frictional resistance, because the height of the wall portion 36*a* is lower than the height of the second wall member 37*a*, there is little reaction force in the direction of the total thickness W2 of the guide member 14, the load applying portion 31, the projecting arm portion 19 and the frictional sliding member 24. This keeps a state with less frictional resistance, so that the upper unit case 3 is rotated and opened with a small force.

As described above, the constraint portion 22 of this embodiment has the wall members 36 and 37*a* that accommodate the guide member 14 and the projecting arm portion 19 of the stand member 12 therebetween. Therefore, the closing motion of the upper unit case 3 is reliably constrained.

Also, the guide member 14 has the reinforcing rib 32 on its side face facing to the wall member 36, the wall member 36 has the lower wall portion 36*a* and a notch portion, and the reinforcing rib 32 abuts on the lower wall portion 36*a* when the guide member 14 is at the constrained position and is exposed through the notch portion when the guide member is at the unconstrained position. Thus, the closing motion of the upper unit case 3 is reliably constrained with a simple structure.

Further, the guide member 14 moves from the constrained position to the unconstrained position substantially along a direction in which a force of gravity acts. Therefore, additional parts for moving the guide member 14 are not required.

In addition, the guide member 14 rotates from the constrained position to the unconstrained position about the engaging claw 25*a* on one end thereof. Thus, the space required for the movement of the guide member 14 is minimized.

Moreover, the guide member 14 has the load applying portion 31 on its side face facing the wall member 37*a* and the projecting arm portion 19 of the stand member 12, the load applying portion 31, thereby making a gap between the guide member 14 and the wall member 37 narrow. Therefore, the closing motion of the upper unit case 3 is reliably constrained.

Also, the load applying portion 31 has an inclined face 31*b*. The gap between the guide member 14 and the wall member 37*a* is gradually narrowed by the inclined face 31*b* in a direction in which the projecting arm portion 19 of the stand member 12 is guided along the guide member 14 during the closing motion. Thus, the closing motion is gradually constrained as the upper unit case 3 is closed.

Additionally, the load applying portion 31 is located at a position corresponding to the reinforcing rib 32 provided on the opposite side face of the guide member 14. Therefore, the closing motion of the upper unit case 3 is effectively constrained.

Further, the projecting arm portion 19 of the stand member 12 has a frictional sliding member 24 that is brought into sliding contact with at least one of the guide member 14 and the constraint portion 22, the frictional sliding member 24 having a higher friction coefficient than the guide member 14 and the constraint portion 22. Thus, the closing motion of the upper unit case 3 is effectively constrained.

In addition, the projecting arm portion 19 of the stand member 12 has the guide pin 20, and the guide member 14 has the guide groove 27 in which the guide pin 20 is slidably inserted. Therefore, the stand member 12 can be smoothly guided by the guide member 14.

Also, the guide groove 27 includes a longitudinal groove 27 in which the guide pin 20 moves during the opening motion and the closing motion, the engagement groove 28 communicated with one end of the longitudinal groove 27 to support the guide pin 20 and hold the upper unit case 3 in the opened state, and the closed position holding groove 29 communicated with the other end of the longitudinal groove 27 to support the guide pin 20 and hold the upper unit case 3 in the closed state. Thus, the opened state and the closed state of the upper unit case 3 is stably maintained.

Additionally, the upper unit case 3 is opened and closed relative to the lower unit case 2. Also, the base end part of the stand member 12 is pivotably attached to the lower unit case 2, and the guide member 14 is attached to the upper unit case 3. Moreover, the image reading portion is accommodated in the upper unit case 3, and the recording portion is accommodated in the lower unit case 2. According to such a structure, the closing motion of the upper unit case 3 is reliably constrained with a simple configuration.

The present invention is not limited to the above embodiment, but various modifications may be made thereto without departing from the scope or spirit of the invention. For example, in the constraint portion 22, the arrangement of the first wall member 36 and the second wall member 37 may be reversed while putting the guide member 14 between them.

Also, apart of the guide member 14 on the rotation reference side may be a rotational center shank, instead of the engaging claw 25. Also, the whole of the guide member 14 may be moved vertically. Moreover, the arrangement of the embodiment may be vertically reversed, that is, the stand member 12 may be secured to the side of the upper unit case 3, and the guide member 14 and the constraint portion 22 may be disposed on the side of the lower unit case 2 to achieve the same effect.

What is claimed is:

1. An image recording apparatus comprising:

an upper unit case;

a lower unit case;

a hinge portion that connects the upper unit case and the lower unit case to be rotationally openable and closable;

a stand member having a first end portion and a second end portion, the first end portion being pivotably attached to one of the upper unit case and the lower unit case;

a guide member attached to the other of the upper unit case and the lower unit case in a manner that the guide member is positioned at a first position when the upper unit case or the lower unit case is substantially closed and the guide member is positioned at a second position different from the first position when the upper unit case or the lower unit case is substantially open, the guide member guiding the second end portion of the stand member; and a constraint portion disposed on the other of the upper unit case and the lower unit case, the constraint portion providing frictional resistance on at least one of the guide member and the second end portion of the stand member when the guide member is at the first position.

2. The image recording apparatus according to claim 1, wherein the constraint portion comprises first and second walls that accommodate the guide member and the second end portion of the stand member therebetween.

3. The image recording apparatus according to claim 2, wherein the guide member comprises a projecting portion on its face facing the first wall;

the first wall has a wall portion and a notch portion; and the projecting portion abuts the wall portion when the guide member is at the first position and is exposed through the notch portion when the guide member is at the second position.

4. The image recording apparatus according to claim 3, wherein the guide member moves from the first position to the second position substantially along a direction in which a force of gravity acts.

5. The image recording apparatus according to claim 4, wherein the guide member rotates from the first position to the second position about one end portion of the guide member.

6. The image recording apparatus according to claim 3, wherein the guide member comprises a load applying portion on its face facing the second wall and the second end portion of the stand member, the load applying portion narrowing a gap between the guide member and the second wall.

7. The image recording apparatus according to claim 6, wherein the load applying portion comprises an inclined face; and the gap between the guide member and the second wall is gradually narrowed by the inclined face in a direction in which the second end portion of the stand member is guided along the guide member during a closing motion.

8. The image recording apparatus according to claim 6, wherein the load applying portion is located at a position corresponding to the projecting portion provided on an opposite side face of the guide member.

9. The image recording apparatus according to claim 2, wherein the second end portion of the stand member comprises a frictional sliding member that is brought into sliding contact with at least one of the guide member and the constraint portion, the frictional sliding member having a higher friction coefficient than the guide member and the constraint portion.

10. The image recording apparatus according to claim 2, wherein the second end portion of the stand member comprises a guide pin; and the guide member has a guide groove in which the guide pin is slidably inserted.

11. The image recording apparatus according to claim 10, wherein the guide groove includes a longitudinal groove in which the guide pin moves during an opening motion and an closing motion, an opened position holding groove communicating with one end of the longitudinal groove to support the guide pin and holding the upper unit case in an opened state, and a closed position holding groove communicating with the other end of the longitudinal groove to support the guide pin and holding the upper unit case in a closed state.

12. The image recording apparatus according to claim 1, wherein the upper unit case is opened and closed relative to the lower unit case.

13. The image recording apparatus according to claim 1, wherein the first end portion of the stand member is pivotably attached to the lower unit case; and the guide member is attached to the upper unit case.

14. The image recording apparatus according to claim 1, further comprising:

an image reading portion accommodated in the upper unit case; and a recording portion accommodated in the lower unit case.

15. The opening and closing mechanism according to claim 1, wherein frictional resistance provided by the constraint portion when the guide member is at the first position is higher than the frictional resistance provided by the constraint portion when the guide member is as the second position.

16. An opening and closing mechanism that connects first and second unit cases to be rotationally openable and closable, comprising:

a stand member having a first end portion and a second end portion, the first end portion being pivotably attached to one of the first unit case and the second unit case;

a guide member attached to the other of the first unit case and the second unit case in a manner that the guide member is positioned at a first position when the first unit case or the second unit case is substantially closed and the guide member is positioned at a second position different from the first position when the first unit case or the second unit case is substantially open, the guide member guiding the second end portion of the stand member; and a constraint portion disposed on the other of the first unit case and the second unit case, the constraint portion providing frictional resistance on at least one of the guide member and the second end portion of the stand member when the guide member is at the first position.

17. The opening and closing mechanism according to claim 16, wherein:

the constraint portion includes first and second walls that accommodate the guide member and the second end portion of the stand member therebetween;

the guide member includes a projecting portion on its face facing the first wall;

the first wall has a wall portion and a notch portion; and the projecting portion abuts the wall portion when the guide member is at the first position and is exposed through the notch portion when the guide member is at the second position.

18. The opening and closing mechanism according to claim 16, wherein:

the second end portion of the stand member includes a sliding member that is brought into sliding contact with at least one of the guide member and the constraint portion, the sliding member having a higher friction coefficient than the guide member and the constraint portion.

19. The opening and closing mechanism according to claim 16, wherein frictional resistance provided by the constraint portion when the guide member is at the first position is higher than the frictional resistance provided by the constraint portion when the guide member is as the second position.

20. An image recording apparatus comprising:

a first unit case;

a second unit case;

a hinge portion that connects the first unit case and the second unit case to be rotationally openable and closable;

a stand member having a first end portion and a second end portion, the first end portion being pivotably attached to the first unit case;

a guide member attached to the second unit case in a manner that the guide member is positioned at a first position when the first unit case or the second unit case is substantially closed and the guide member is positioned at a second position different from the first position when the first unit case or the second unit case is substantially open, the guide member guiding the second end portion of the stand member; and a constraint portion disposed on the second unit case, the constraint portion providing frictional resistance on at least one of the guide member and the second end portion of the stand member, wherein frictional resistance provided by the constraint portion when the guide member is at the first position is higher than frictional resistance provided by the constraint portion when the guide member is at the second position.

* * * * *